United States Patent [19]

Owada et al.

[11] Patent Number: 4,691,909

[45] Date of Patent: Sep. 8, 1987

[54] DEVICE FOR TURNING OVER BOOK LEAVES

[75] Inventors: Toshiro Owada; Kenichi Kosugi, both of Atsugi; Yasuo Nagase, Machida, all of Japan

[73] Assignees: Ministry of International Trade & Industry; Agency of Industrial Science & Technology, both of Tokyo, Japan

[21] Appl. No.: 845,443

[22] Filed: Mar. 28, 1986

[30] Foreign Application Priority Data

Apr. 18, 1985 [JP] Japan ..... 60-81226

[51] Int. Cl.[4] ..... B65H 39/02; G09F 11/00

[52] U.S. Cl. ..... 270/58; 84/487; 40/531; 40/475

[58] Field of Search ..... 270/58, 1.1; 84/486, 84/487; 271/18, 104, 109; 400/634, 718, 87; 281/45; 40/342, 343, 531, 475

[56] References Cited

U.S. PATENT DOCUMENTS

| | | | |
|---|---|---|---|
| 2,176,483 | 10/1939 | Barron | 40/531 |
| 2,484,106 | 10/1949 | Mallina | 84/487 |
| 3,216,719 | 11/1965 | Flora | 270/58 |
| 3,808,720 | 5/1974 | Smith | 40/531 |
| 4,031,644 | 6/1977 | Rogers | 84/487 |
| 4,102,071 | 7/1978 | D'Arcy | 40/531 |
| 4,160,334 | 7/1979 | Willis | 84/487 |
| 4,516,866 | 5/1985 | Yamauchi et al. | 40/531 |
| 4,545,141 | 10/1985 | Ito et al. | 84/487 |
| 4,553,467 | 11/1985 | Goldner | 84/487 |
| 4,644,675 | 2/1987 | Berger et al. | 84/487 |

FOREIGN PATENT DOCUMENTS

| | | | |
|---|---|---|---|
| 151328 | 11/1979 | Japan | 270/1.1 |

*Primary Examiner*—E. H. Eickholt

*Attorney, Agent, or Firm*—Oblon, Fisher, Spivak, McClelland & Maier

[57] ABSTRACT

A device for turning over book leaves is disclosed, which comprises a book holder for supporting a book in an open state, a movable unit disposed above the book holder and capable of vertical and horizontal movement, and a turn-over roller and a pinch member both mounted in said movable unit. The turn-over roller is brought into contact with the page of the book to be turned over with the movement of the movable unit. Then it is rotated toward the book seam to cause a plurality of book leaves including a leaf to be turned over to be turned up in between it and the pinch member. Then it is rotated in the opposite direction to release the turned-up leaves other than the leaf to be turned over. The remaining leaf to be turned over is moved with the movement of the movable unit toward the book seam to effect the turn-over.

4 Claims, 19 Drawing Figures

FIG. 3
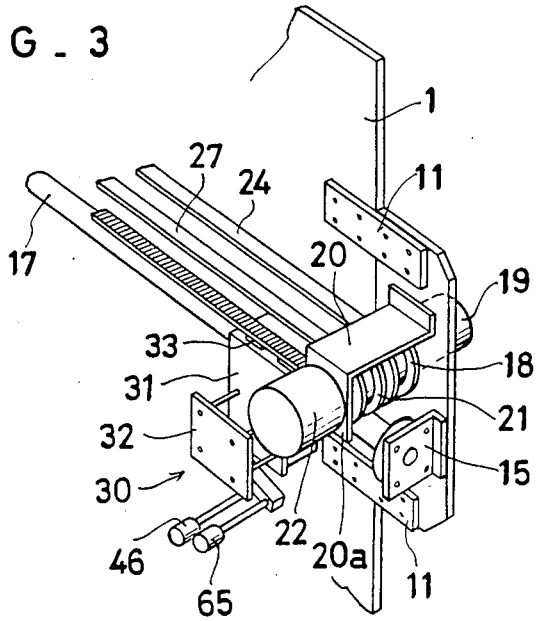
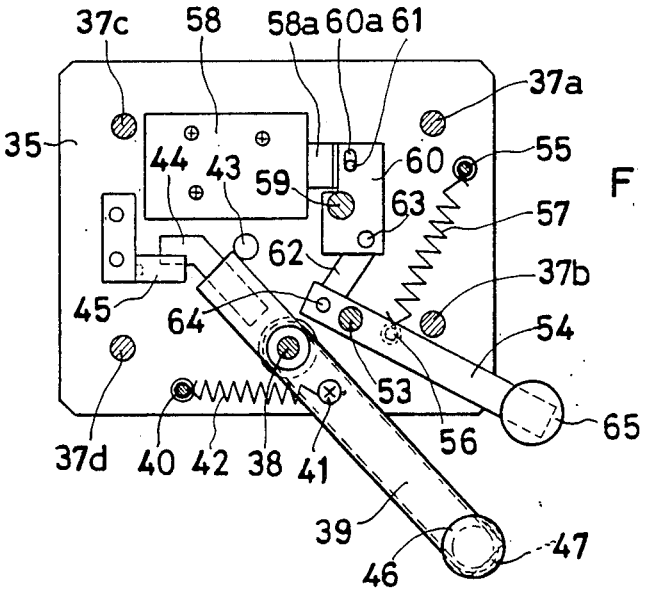
FIG. 4

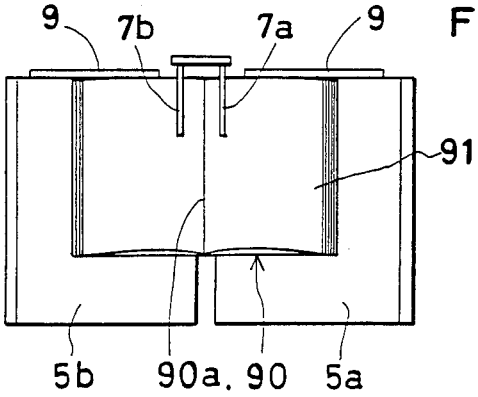
FIG. 8(a)
FIG. 8(b)
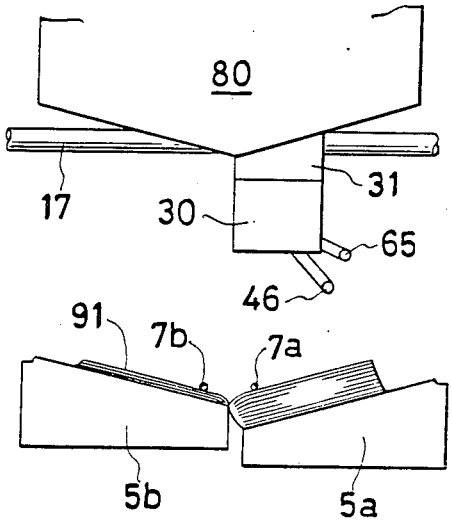
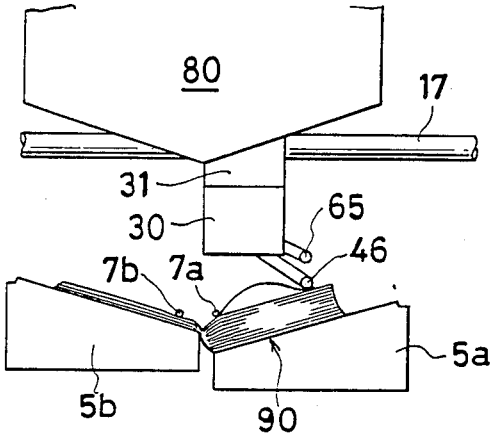
FIG. 9

(a)

(b)

DEVICE FOR TURNING OVER BOOK LEAVES

FIELD OF THE INVENTION AND RELATED ART STATEMENT

This invention relates to a device for automatically turning over book leaves one after another.

There have been developed various devices for automatically turning over bound leaves held in an open state one after another. All of such devices are used for turning over leaves of a substantially fixed size and hardness such as those of a bankbook. Recently, a strong demand has arisen for a device which can automatically turn over bound leaves one after another reliably even in cases where the size, number of pages and hardness of the paper vary.

OBJECT AND SUMMARY OF THE INVENTION

An object of the invention is to provide a device which can automatically turn over bound leaves one after another reliably even in cases where the size, number of pages and hardness of the paper vary.

To attain the above object of the invention, there is provided a device for turning over book leaves, which comprises:

a book holder for supporting a book in an open state;

a movable unit disposed above the book holder and movable substantially vertically with respect thereto and also in directions substantially perpendicular to the seam of the book supported on the book holder;

a turn-over roller mounted in the movable unit for being brought into forced contact with the surface of the book on the side thereof to be turned over from above, then rotated in this state toward the book seam to turn up several leaves of the book and then rotated in the opposite direction to release the turned-up leaves other than the leaf to be turned over; and a pinch member also mounted in the movable unit, for clamping the remaining turned-up leaf to be turned over in co-operation with the turn-over roller.

With this structure, the turn-over roller is brought into contact with the book supported on the book holder on the side of the book to be turned over with a relative movement of the movable unit and the book holder. The turn-over roller is then rotated toward the book seam to turn up a plurality of leaves of the book including the leaf to be turned over, in between the turn-over roller and pinch member. The turn-over roller is then rotated in the opposite direction to cause the turned-up leaves other than the leaf to be turned over to escape from between the turn-over roller and pinch member. The leaf to be turned over is then clamped between the turn-over roller and pinch member, and the movable unit is moved relative to the book holder toward the book seam. In this way, turnover of a book leaf is effected.

According to the invention, a plurality of leaves are first turned up, and then the turned-up leaves other than one to be turned over are released, and the leaf to be turned over is moved in a clamped state beyond the book seam. Thus, leaves can be automatically turned over one after another without possibility of no leaf or more than one leaf being turned over during a turn-over operation, irrespective of the quality of the paper.

The above and other objects and features of the invention will become more apparent from the following detailed description with reference to the accompanying drawings.

BRIEF DESCRIPTION OF THE DRAWINGS

FIG. 3 is a perspective view showing a right movable unit and a drive mechanism therefor in the device shown in FIG. 1;

FIG. 4 is a schematic front view showing an essential part of the right movable unit;

FIG. 8(*a*) is a plan view showing the device of FIG. 1 with a book kept in an open state;

FIG. 8(*b*) is a front view showing the device of FIG. 1 with a book kept in an open state;

FIG. 9 is an explanatory view showing the device at the instant of start of turn-over of a book leaf;

FIG. 17(*b*) is an explanatory view for turning over book leaves with the device shown in FIG. 17(*a*).

DETAILED DESCRIPTION OF PREFERRED EMBODIMENTS

Figure 1:
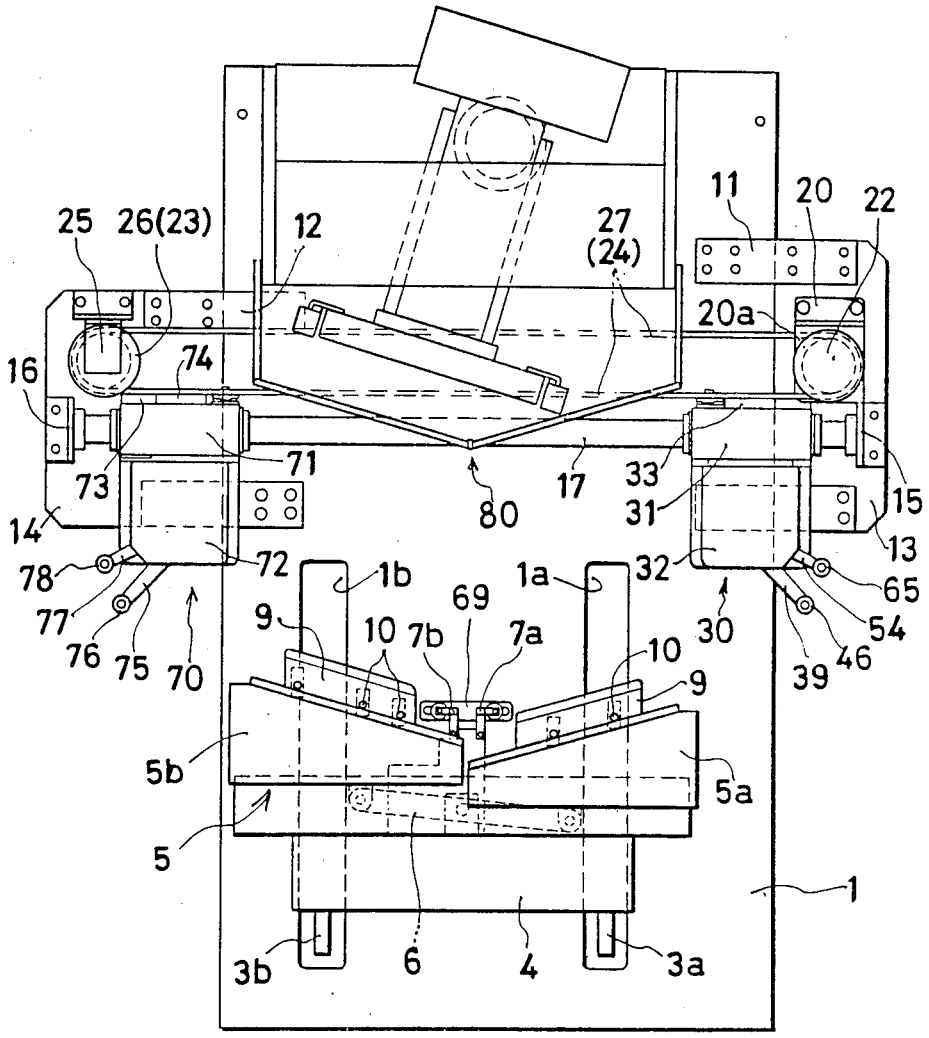
FIG. 1 is a front view showing an embodiment of the device for turning over book leaves according to the present invention.
Figure 2:
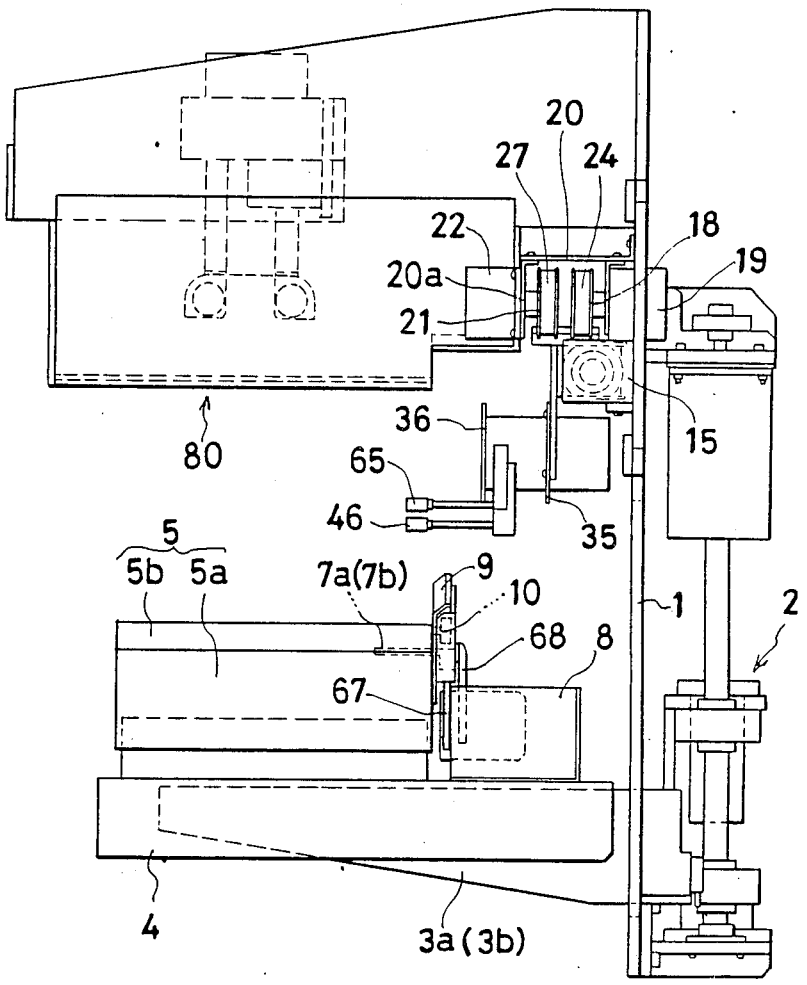
FIG. 2 is a right side view showing the device shown in FIG. 1.

Referring to FIGS. 1 and 2, reference numeral 1 designates an upright base plate secured to a device housing (not shown). As shown in FIG. 2, a lift 2 is provided on the back side of the upright base plate 1. The upright base plate 1 has two, i.e., right and left (in FIG. 1), vertical slots 1*a*, 1*b*. Lift arms 3*a*, 3*b*, which are secured at one end to the lift 2, extend horizontally through the vertical slots 1*a*, 1*b* to the front side of the upright base plate 1. The lift arms 3*a*, 3*b* are movable vertically by the lift 2 along the vertical slots 1*a* and 1*b*.

A base plate 4 is mounted on the lift arms 3*a*, 3*b* for movement in the transverse directions (in FIG. 2). In order to make the positioning of a book easier, a book holder 5 consisting of two halves 5*a*, 5*b* is mounted on top of the base plate 4 for vertical movement by a see-saw mechanism 6.

Figure 6:
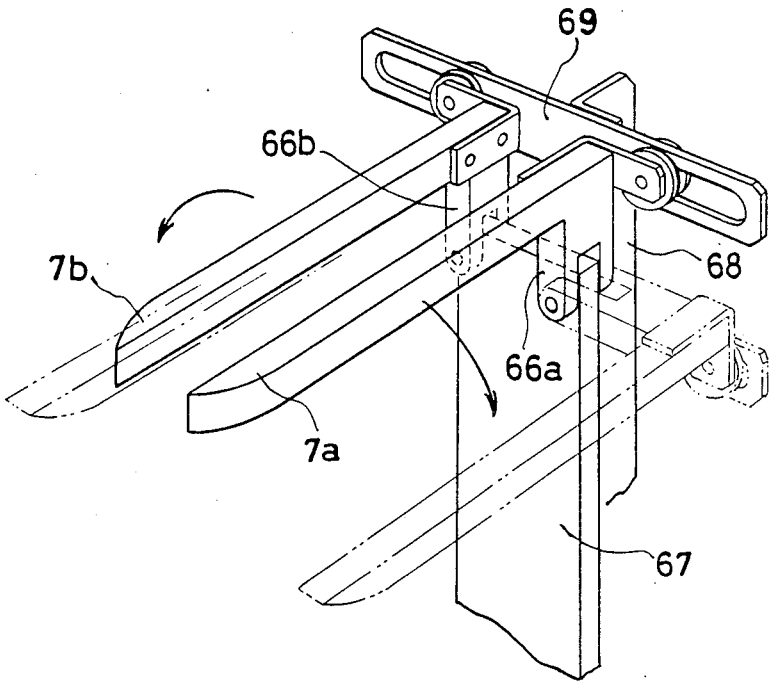
FIG. 6 is a perspective view showing an essential part of the mechanism of keep members used in the device shown in FIG. 1.

The book holder halves 5*a*, 5*b* have top surfaces inclined downwardly toward their adjoining edges. On one side portion of the book holer 5 nearer the upright base plate 1, there is provided a movable holder 8 which is movable in the transverse direction in FIG. 2 by use of a driving device (not shown). The movable holder 8 is provided with two keep members 7*a*, 7*b* each having a supporting end portion formed as bent in an "L" shape as shown in FIG. 6. Each supporting end portion is mounted on the upper portion of a crank 68 in such a manner that it is slidably supported by one of guide slots bored in an arm member 69 and pivotally supported at its free end portion 66*a* (66*b*) by a supporting plate 67. With the crank 68 being moved downward the keep members 7*a*, 7*b* rotate outward around the respective free end portions thereof and move downward so as to press down a book in the open state.

The book holder halves 5*a*, 5*b* have respective mounting plates 9 mounted on their end faces nearer the upright base plate 1. A plurality of detectors 10 are installed on the mounting plates 9 for detecting book size. As for the detectors 10, there are included photointerrupters and microswitches for example.

Figure 5:
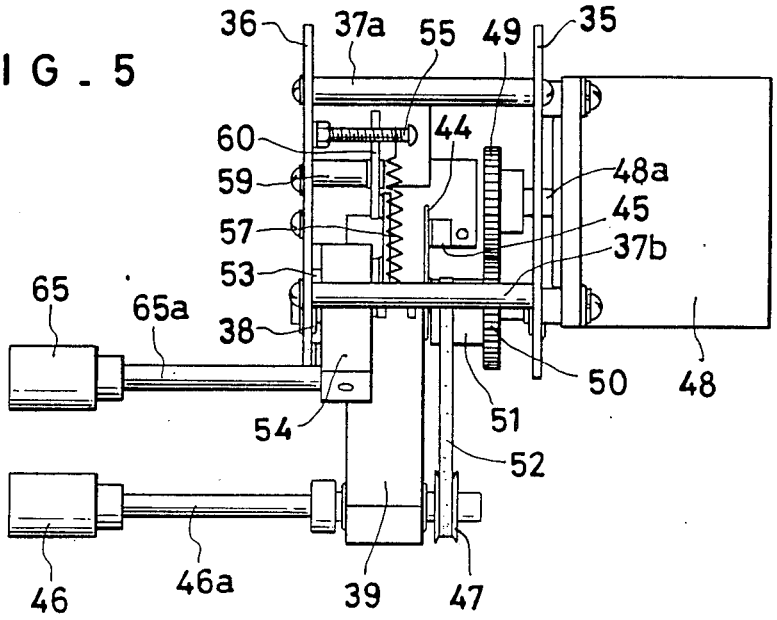
FIG. 5 is a right side view showing the right movable unit shown in FIG. 4.

FIG. 3 is a perspective view showing a mechanism section secured to an upper portion of the upright base plate 1 and including movable units to be described later. FIG. 4 is a front view showing an essential part of a movable unit, and FIG. 5 is a right side view of the movable unit.

As shown in FIGS. 1 and 3, right and left auxiliary plates 13, 14 are secured by mounting plates 11, 12 to an upper portion of the upright base plate 1 such that they projects from the opposite edges of the upright base plate 1. Mounting plates 15, 16 are secured to a lower portion of the respective right and left auxiliary plates 13, 14. A guide rod 17 is secured to the mounting plates 15, 16 such that it extends horizontally and parallel to the upright base plate 1.

The right auxiliary plate 13 supports a drive gear 18 rotatably mounted on its front side and above the guide rod 17 and a motor 19 secured to its back side for rotating the drive gear 18. An L-shaped plate 20 is secured to the front side of the right auxiliary plate 13, and has a downwardly bent end portion 20*a*. A drive gear 21 is rotatably mounted on the downwardly extending end portion 20*a* on the back side thereof, and a motor 22 for driving the drive gear 21 is secured to the front side of the portion 20*a*.

The left auxiliary plate 14 supports a driven gear 23 mounted on the front side. A timing belt 24 is passed round the drive gear 18 and driven gears 23. An L-shaped plate 25 is secured to the left auxiliary plate 14, and a driven gear 26 is rotatably mounted on a downwardly extending end portion 25*a* of the L-shaped plate 25 on the back side of the portion 25*a*. A timing belt 27 is passed between the driven gear 21 and driven gears 26.

A right movable unit 30 is slidably mounted on a right portion of the guide rod 17. The right movable unit 30 includes an angular body 31 slidably mounted on the guide rod 17 and a moving member 32 secured to the angular body 31 and carrying a turn-over roller 46 and a pinch member 65 to be described later in detail. The top of the angular body 31 is secured by a securing member 33 to the underside of the lower run of the front side timing belt 27. The right movable unit 30 is thus moved along the guide rod 17 with the front side timing belt 27.

A left movable unit 70 is slidably mounted on a left portion of the guide rod 17. The left movable unit 70, like the right movable unit 30, includes an angular body 71 slidably mounted on the guide rod 17 and a moving member 72 secured to the angular body 71. The top of the angular body 71 is secured by a horizontal plate 73 extending toward the upright base plate 1 and a securing member 74 to the rear timing belt 24. The left movable unit 70 is movable along the guide rod 17 with the rear timing belt 24.

The moving member 32 of the right movable unit 30 has a base plate 35 depending from the angular body 31 (see FIG. 3). As shown in FIG. 5, a front plate 36 is secured by four support pins 37*a*, 37*b*, 37*c*, 37*d* to the base plate 35 in parallel with each other. A first arm 39 is rotatably mounted by a pin 38 on the front plate 36 such that it is downwardly inclined. The first arm 39 is biased in the clockwise direction (in FIG. 4) by a tension spring 42 attached between a pin 41 mounted thereon and a pin 40 provided on a lower portion of the front plate 36. Its rotation in this direction is limited by a stopper 43 provided on the front plate 36. A sensor arm 44 is provided on the upper end of the first arm 39. A sensor 45 is mounted on the front plate 36 at a position underneath the end of the sensor arm 44. When the first arm 39 is rotated by a predetermined angle in the counterclockwise direction, the sensor 45 detects the sensor arm 44.

The first arm 39 carries a roller shaft 46*a* projecting horizontally forwardly from its lower end. A front end portion of the roller shaft 46*a* is constituted by a turn-over roller 46 made of rubber or like material. A pulley 47 is secured to the rear end of the roller shaft 46*a*.

As shown in FIG. 5, a pulse motor 48 is secured to the back side of the base plate 35. The rotation of the drive shaft 48*a* of the pulse motor 48 is transmitted to a gear 50 mounted on the base plate 35 through a gear 49 secured to the drive shaft 48*a*. A pulley 51 is secured to the shaft of the gear 50. A belt 52 is passed round the pulleys 47, 51. The roller shaft 46*a* is rotated with the driving of the belt 52.

A second arm 54 is rotatably mounted by a pin 53 on the front plate 36 such that it extends beneath the first arm 39 and is downwardly inclined. The second arm 54 is biased in the counterclockwise direction (in FIG. 4) by a tension spring 57 attached between a pin 56 provided thereon and a pin 55 provided on an upper portion of the front plate 36. Its rotation in this direction is limited by the pin 37*b*.

A solenoid 58 is secured to an upper portion of the front plate 36. A rotatable plate 60 is rotatably mounted on the front plate 36 by a shaft 59. A pin 61 provided on the plunger 58*a* of the solenoid 58 is inserted in a slot 60*a* provided in an upper portion of the rotatable plate 60. The lower end of the rotatable plate 60 is linked by a pin 63 to the upper end of a link 62. The lower end of the link 62 is pinned by a pin 64 to the upper end of the second arm 54. When the solenoid 58 is driven, the plunger 58*a* is moved to the left (in FIG. 4) so that the rotatable plate 60 is rotated about the shaft 59 in the counterclockwise direction. As a result, the second arm 54 is rotated by the link 62 by a predetermined angle in the clockwise direction against the spring force of the tension spring 57. The second arm 54 carries a roller shaft 65*a* secured to its lower end and extending horizontally forwardly to the same extent as the roller shaft 46*a*. A front end portion of the roller shaft 65*a* is constituted by a pinch member 65 made of rubber or like material.

The left movable unit 70, like the right movable unit, has a first arm 75, a turn-over roller 76, a second arm 77 and a pinch member 78.

The left and right movable units 70, 30 are entirely the same in structure except that they are mirror images of each other, so the detailed description of the left movable unit 70 is omitted.

As shown in FIGS. 1 and 2, an optical character reader 80 is secured to an upper portion of the upright base plate 1.

The lift 2 for raising and lowering the book holder 5, drivers (not shown) for driving the keep members 7*a* and 7*b* of the movable holder 8 for keeping a book in an open state, the motors 19 and 22 for moving the right and left movable units 30 and 70, the pulse motor 48 for rotating the turn-over roller 46 and the solenoid 58 for rotating the second arm 54, are all controlled by a control circuit (not shown) to perform a turn-over operation to be described hereinbelow.

Now, the turn-over operation will be described in case of a book whose page numbers increase from the left side to the right side (i.e., a book where the right side leaf is turned over to the left side). The book is first open to present a desired page and is supported in this state on the book holder 5. Then, the book holder 5 is raised by the lift 2 to press against and read in the optical character reader 80 the left and right open side pages of the book 90. Subsequently, the book holder 5 is lowered by the lift 2. The keep members 7*a* and 7*b* are then advanced with the horizontal movement of the movable holder 8 and are lowered with the descending movement of the cam plate 67 to press the left and right open pages of the book 90 at positions near the seam of the book, as shown in FIGS. 8(*a*) and 8(*b*). When the left and right side parts of the book have different thicknesses at this time, the levels of the book holder halves 5*a* and 5*b* are adjusted with the see-saw mechanism 6 to level the left and right open side surfaces. For this reason, the right and left open side pages can be read out with exactitude.

Instead of the optical character reader, a duplicator is applicable.

Afterwards, the right movable unit 30 is moved to the left along the guide rod 17 with the timing belt 27 driven by the motor 22. It is stopped at a position at which the turn-over roller 46 and pinch member 65 are found slightly inwardly of the right edge of the right open page 91 of the book 90, as shown in FIG. 8(*b*). This position of the movable unit is determined by the size of the book 90 as detected by the book size detector 10 provided on the mounting plate 9 of the book holder 5.

Then, the book holder 5 is raised by the lift 2, thus bringing the right side page 91 into contact with the turn-over roller 46, as shown in FIG. 9. With the ascent of the book holder 5 at this time, the first arm 39 is rotated in the counterclockwise direction (in FIG. 4) against the spring force of the tension spring 42. When the sensor arm 44 extending from the upper end of the first arm 39 reaches the sensor 45, the sensor 45 produces a detection signal. In response to this detection signal, the ascent of the book holder 5 caused by the lift 2 is stopped.

Figure 10:
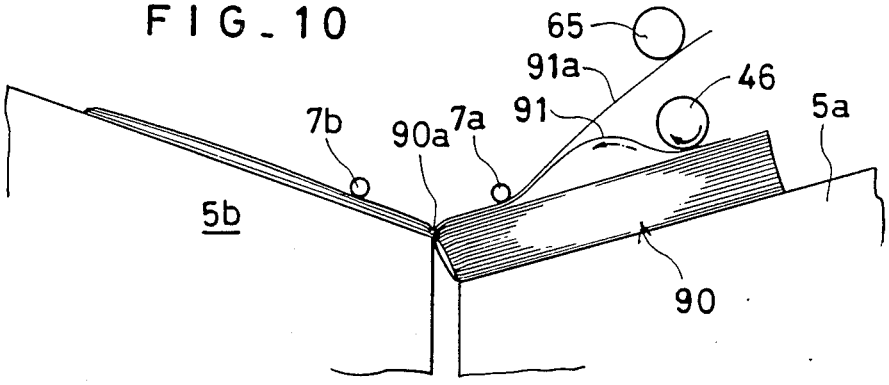
FIGS. 10 to 15 are explanatory views illustrating the progress of a book leaf turn-over operation.
Figure 11:
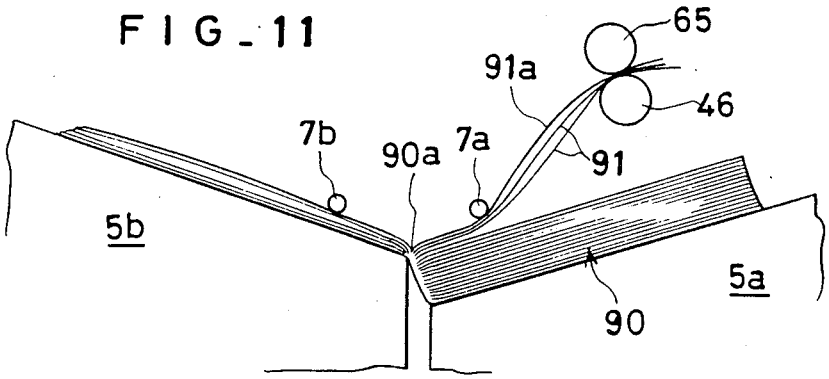

Then, the pulse motor 48 is rendered operative to cause rotation of the turn-over roller 46 in the clockwise direction as shown in FIG. 9 through the gears 49 and 50 and belt 52. The turn-over roller 46 is urged against the page due to the biasing force of the tension spring 42, so that it provides a sufficient frictional force to the page. The right side page leaf 91 thus is caused to slide toward the book seam 90*a*. As this sliding of the leaf 91 proceeds, its central portion becomes increasingly convex upwards to be eventually turned up between the turn-over roller 46 and the pinch member 65 found thereabove, as shown in FIG. 10. Several subsequent leaves are also successively turned up in contact with the turn-over roller 46. During this time, the right movable unit 30 may be moved slightly to the left. This will facilitate the turn-up. After several leaves have been turned up between the turn-over roller 46 and the pinch member 65 in the above way, the book holder 5 is lowered. As a result, the turn-over roller 46 is separated from the book 90, as shown in FIG. 11, thus bringing the turn-up to an end.

Afterwards, the solenoid 58 is rendered operative to cause movement of the plunger 58*a* to the left (in FIG. 4). As a result, the second arm 54 is rotated in the clockwise direction through the rotatable plate 60 and link 62, so that the turned-up leaves are clamped between the turn-over roller 46 and the pinch member 65, as shown in FIG. 11.

Figure 12:
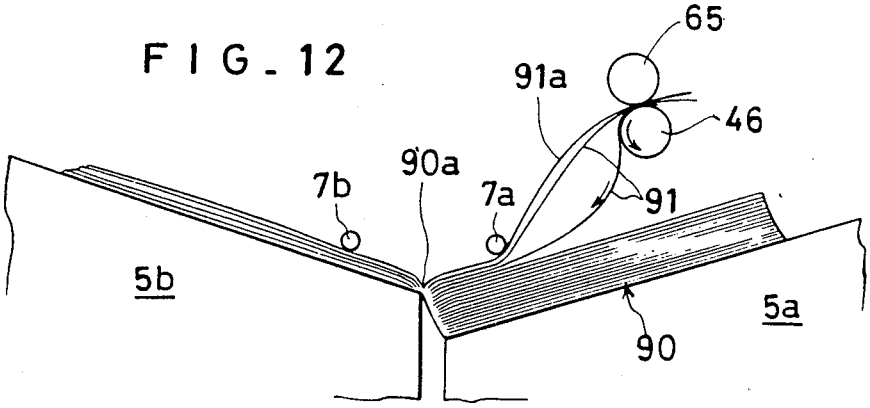
Figure 13:
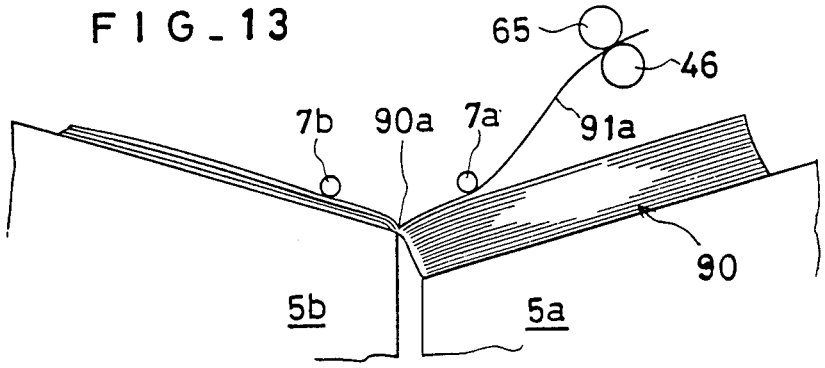

The pulse motor 48 then is driven in the opposite direction. As a result, the turn-over roller 46 is rotated in the counterclockwise direction as shown in FIG. 12. Of the plurality of turned-up and clamped leaves the lowermost leaf 91 in contact with the turn-over roller 46 receives a frictional force therefrom such that it is pulled down because the frictional force between it and the turn-over roller 46 is greater than the frictional force between adjacent leaves. Therefore, the clamped leaves escape one after another from between the pinch member 65 and the turn-over roller 46 toward the book 90, as shown in FIG. 12. The last clamped leaf 91*a*, however, remains clamped as shown in FIG. 13 because of the friction force between it and the pinch member 65. At this moment, the driving of the pulse motor 48 is stopped.

Thereafter, the keep members 7*a*, 7*b* which have kept the book 90 in the open state are retracted with the movable holder 8 toward the upright base plate 1.

Figure 14:
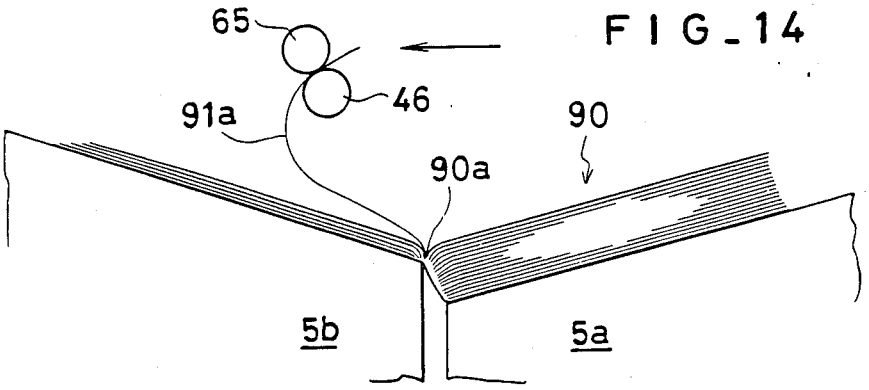
Figure 15:
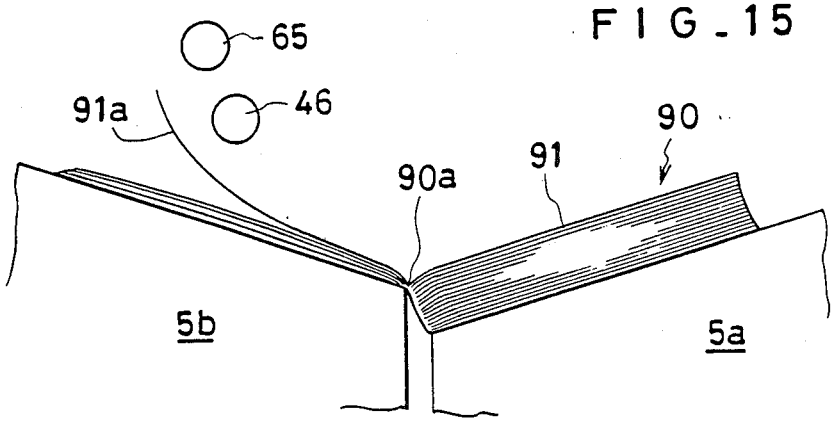

Subsequently, the motor 22 is driven to cause movement of the right movable unit 30 to the left. With this movement, the leaf 91*a* remaining clamped between the turn-over roller 46 and the pinch member 65 is carried to the left page side past the book seam 90*a*, as shown in FIG. 14. During this time, the solenoid 58 is deenergized, causing rotation of the second arm 54 in the counterclockwise direction (in FIG. 4) by the biasing force of the tension spring 57. The pinch member 65 is thus raised. Thus, the turned-over leaf 91*a* escapes from between the turn-over roller 46 and the pinch member 65 to fall onto the left side of the book 90. In the above way, the turn-over of one leaf is completed.

Afterwards, the right movable unit 30 is brought back to the right end of the guide rod 17 to recover the state as shown in FIG. 1.

Figure 7:
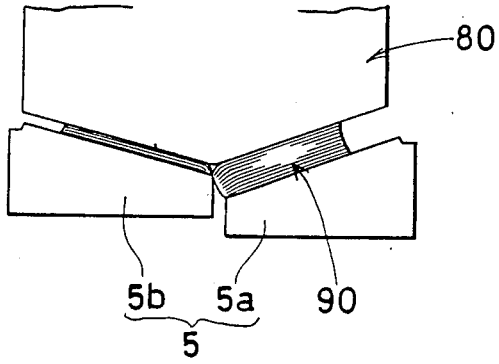
FIG. 7 is a view for explaining the reading of a book using the device shown in FIG. 1.

The book holder 5 is subsequently raised by the lift 2 into contact with the underside of the optical character reader 80 as shown in FIG. 7 to be ready for the read-out.

When the read-out of the open pages is completed, the book holder 5 is lowered again, and the operation of turning over the right side leaf to the left side and the following read-out operation are performed repeatedly in the manner as described.

As the leaf turn-over operation is performed repeatedly, the level of the left book holder half 5*b* is progressively lowered, while the level of the right book holder half 5*a* is progressively raised. The see-saw mechanism 6 functions to level the surfaces of the two sides.

In case of a book in which the leaves are successively turned over from the left side to the right side, similar operation is performed with the left movable unit 70 instead of the right movable unit 30.

Figure 16:
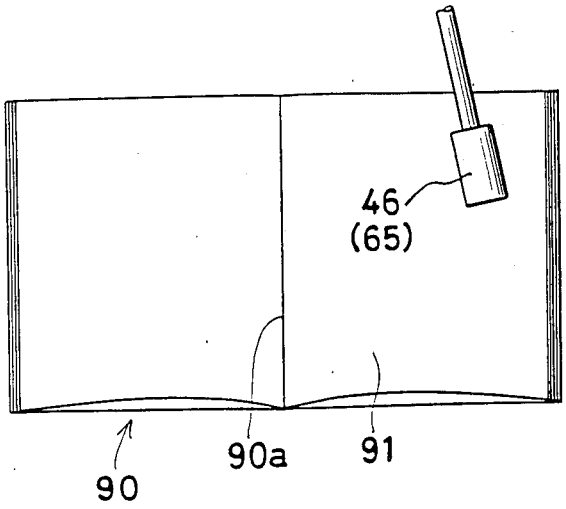
FIG. 16 is a front view showing an essential part of a different embodiment of the device for turning over book leaves according to the invention.

The turn-over roller 46 and the pinch member 65 need not be parallel to the seam 90*a* of the book 90, but they may be slightly inclined relative thereto, as shown in FIG. 16. When the roller 46 is inclined relative to the seam 90*a*, as described above, a short length of curved portion of a leaf to be raised will suffice.

Figure 17:
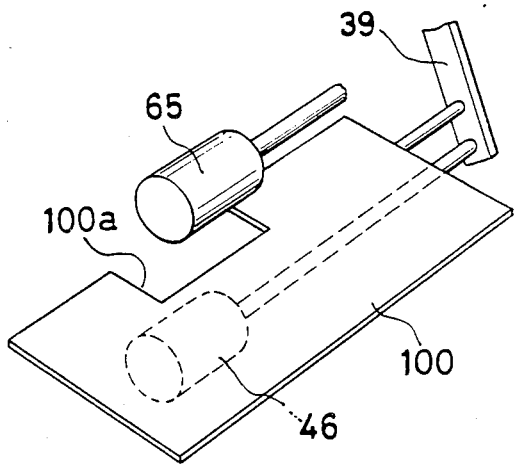
FIG. 17(*a*) is a perspective view showing a further embodiment of the device for turning over book leaves according to the invention.
Figure 17:
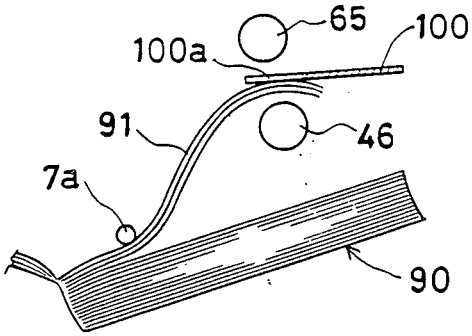

Further, as shown in FIGS. 17(*a*) and 17(*b*) a keep plate 100 may be provided on the first arm 39 so that a plurality of turned-up leaves are led in between the plate 100 and the turn-over roller 46. In this case, the pinch member 65 is lowered through a notch 100*a* formed in the keep plate 100 to clamp the remaining leaf between it and the turn-over roller 46.

As has been described in the foregoing, with the device for turning over book leaves the turn-over roller is brought into contact with a book at a position thereof according to the book size, the turn-over roller is then rotated to give a frictional force to the book in the direction toward the book seam to cause the leaf to be turned over and also leaves under this leaf to be turned up, the turn-over roller is then rotated in the opposite direction to release the turned-up leaves except for the leaf to be turned over, and the remaining turned-up leaf to be turned over is moved in the state clamped between the pinch member and the turn-over roller beyond the book seam. It is thus possible to realize automatic turn-over of book leaves reliably and accurately without possibility of no leaf or more than one leaf being turned-over, irrespective of the size of the book or the quality of the paper.

What is claimed is:

1. A device for turning over book leaves comprising:

a book holder having means for supporting a book in an open state;

a moveable unit disposed above said book holder and mounted on means for moving said movable unit substantially vertically with respect thereto and also in direction substantially perpendicular to a seam of the book supported on said book holder;

a turn-over roller rotatably mounted on said movable unit such that said turn-over roller may be brought into forced contact from above with the surface of the book on said book holder, then rotated in this contacting state to turn up towards the book seam several leaves of the book and then rotated in an opposite direction to release the turned-up leaves other than the leaf to be turned over; and a pinch member rotatably mounted on said movable unit at a position for clamping the remaining turned-up leaf being turned over in co-operation with an upper portion of said turn-over roller;

wherein said turn-over roller is brought into contact with the book supported on said book holder with a relative movement of said movable unit and said book holder, said turn-over roller being then rotated to turn up towards the book seam a plurality of leaves of the book including the leaf to be turned over while holding said leaf to be turned over in between said turn-over roller and said pinch member, said turn-over roller being then rotated in the opposite direction to cause the turned-up leaves other than the leaf to be turned over to escape from between side turn-over roller and said pinch member, the leaf to be turned over being then clamped between said turn-over roller and said pinch member, said movable unit being then moved relative to said book holder toward the book seam.

2. The device according to claim 1, wherein said book holder consists of two halves having tops, said tops being mutually downwardly inclined toward one another.

3. The device according to claim 2, including means for supporting said two halves for vertical movement by a see-saw mechanism.

4. The device according to claim 1 wherein axes of rotation of said turn-over roller and said pinch member are inclined relative to said book seam when viewed from above said book supported by said book holder.

* * * * *